US007181793B2

(12) United States Patent
Lee

(10) Patent No.: US 7,181,793 B2
(45) Date of Patent: Feb. 27, 2007

(54) BED TO ADJUST THE SLOPE OF THE BED ACCORDING TO BRAIN WAVES AND A METHOD THEREBY

(76) Inventor: Seung Jae Lee, B102, 547-9, I-dong, Ansan-si, Gyeonggi-do (KR)

( * ) Notice: Subject to any disclaimer, the term of this patent is extended or adjusted under 35 U.S.C. 154(b) by 0 days.

(21) Appl. No.: 10/532,510

(22) PCT Filed: Oct. 13, 2003

(86) PCT No.: PCT/KR03/02113

§ 371 (c)(1),
(2), (4) Date: Apr. 25, 2005

(87) PCT Pub. No.: WO2004/037048

PCT Pub. Date: May 6, 2004

(65) Prior Publication Data

US 2006/0042010 A1 Mar. 2, 2006

(30) Foreign Application Priority Data

Oct. 28, 2002 (KR) ..... 10-2002-0065747

(51) Int. Cl.
*A47B 7/00* (2006.01)

(52) U.S. Cl. ..... 5/610; 5/600; 482/144

(58) Field of Classification Search ..... 5/610, 5/641, 616; 482/143–144; 463/36
See application file for complete search history.

(56) References Cited

U.S. PATENT DOCUMENTS 2,639,206 A * 5/1953 Butler ..... 5/621
3,081,085 A * 3/1963 De Girolamo ..... 482/144
3,561,022 A * 2/1971 James ..... 5/657
3,568,669 A * 3/1971 Stites ..... 606/244
4,672,697 A * 6/1987 Schurch ..... 5/610
5,125,884 A * 6/1992 Weber et al. ..... 482/145
5,571,057 A * 11/1996 Ayers ..... 463/36
5,638,826 A * 6/1997 Wolpaw et al. ..... 600/544
5,772,508 A * 6/1998 Sugita et al. ..... 463/36
5,967,956 A * 10/1999 Teeter ..... 482/144
6,167,298 A * 12/2000 Levin ..... 600/545
6,795,724 B2 * 9/2004 Hogan ..... 600/545
2003/0145383 A1 * 8/2003 Schwaegerle ..... 5/610

* cited by examiner

*Primary Examiner*—Patricia Engle
*Assistant Examiner*—Jonathan Liu
(74) *Attorney, Agent, or Firm*—Brown & Michaels, PC

(57) ABSTRACT

The present invention relates to a bed to adjust a slope of the bed according to brain waves and a method thereby, to adjust the slope to generate the maximum alpha waves of brain waves which are generated by the change of the blood amount to be provided in a bed user's brain. For this, there is provided a bed to adjust the slope of the bed according to brain waves that an ankles fixing device 14 is mounted at one side of the bed 12 and which is capable of rotating within predetermined angles around a rotation central hinge 18 which is installed at one side of the lower surface of the bed, wherein the bed comprises brain waves detection means 50 which is mounted at another side of the bed 12, and which user is able to put on, separation means for separating alpha waves and beta waves having predetermined frequency range from output signals of the brain waves detection means 50, and adjustment means for adjusting the inclination of the bed 12 so that the maximum alpha waves can be detected based on the alpha waves and the beta waves.

11 Claims, 6 Drawing Sheets

BED TO ADJUST THE SLOPE OF THE BED ACCORDING TO BRAIN WAVES AND A METHOD THEREBY

TECHNICAL FIELD

The present invention relates to a bed to adjust the slope of the bed, more especially relates to a bed to adjust the slope to generate the maximum alpha waves of brain waves which are generated by the change of the blood amount to be provided in bed user's brain.

BACKGROUND ART

Generally, brain waves mean the electrical flow when signals between cranial nerves are transmitted, and are divided by slow waves and fast waves. For example, delta waves which are slow are formed in case for a man to sleep, and beta waves which are fast are formed in case for a man to be active, and alpha waves which approximately have a medium velocity are formed in case for a man to be meditative. The features of brain waves as being generated above are below described.

Delta waves have the frequency range from 0.5 Hz to 4 Hz, and have unconsciousness state level. The delta waves are presented in a deep sleep or a comatose state, and are especially presented in babies' brain waves.

Theta waves have the frequency range from 4 Hz to 8 Hz, and have internal consciousness state level. The theta waves are presented in an emotionally stable state or in case for a man to begin to sleep, and are also presented in an initiative state, a relaxation state.

Alpha waves have the frequency range from 8 Hz to 14 Hz, and have internal consciousness state level. The alpha waves are presented in a relaxation state or in a tranquil state, and are also presented in a peaceful state physically and mentally.

Beta waves have the frequency range from 14 Hz to 30 Hz, and have consciousness state level. The beta waves are presented in a conscious activity state, for example, waking up, talking, etc, and are especially presented in an anxious state or a tense state.

Gamma waves have the frequency range from 30 Hz to 50 Hz, and have consciousness state level. The gamma waves are presented in case to watch exiting sports games or to solve very difficult mathematics problems.

Accordingly, it is profitable to let alpha waves released in a brain so as to mitigate tension such that may enhance the health.

Recently, a lot of beds which are capable of being inclined with fixing ankles have been developed so as to support health. These beds operate to face a head downward and legs upward so as to flow blood to head part. In accordance with that, alpha waves are presented in a body, and pulse waves by heart become stable, and blood pressure is dropped such that user may become in a stable state mentally and physically.

However, traditional beds have a deficiency that traditional beds and methods thereby are not systematical because both the inclination and the duration are controlled based on user's experience.

Also, they have a deficiency that users like old aged men and children cannot deal with a sudden change because traditional beds and methods thereby have no standard to incline those.

DETAILED DESCRIPTION OF THE INVENTION

The primary object of the present invention is to provide a bed to adjust the slope of the bed according to brain waves and a method thereby, by detecting brain waves and pulse waves in a real time and automatically controlling the inclination of the bed to maximize alpha waves.

The secondary object of the present invention is to provide a bed to adjust the slope of the bed according to brain waves and a method thereby which is capable of preventing from providing excessive blood into a head by controlling the inclination of the bed, which sets an operation time by a timer, and which user is able to numerically verify the inclination.

To achieve these and other advantages and in accordance with the purpose of the present invention, there is provided a bed to adjust the slope of the bed 12 according to brain waves which an ankles fixing device 14 is mounted at one side thereof, and which is capable of rotating within predetermined angles around a rotation central hinge 18 which is installed at one side of the lower surface of the bed, wherein the bed comprises brain waves detection means 50 which is mounted at another side of the bed 12, and which user is able to put on, separation means for separating alpha waves and beta waves having predetermined frequency range from output signals of the brain waves detection means 50, and adjustment means for adjusting the inclination of the bed 12 so that the maximum alpha waves can be detected based on the alpha waves and the beta waves.

The adjustment means comprises a control section 60 which outputs a rotation instruction so as to rotate the bed 12 by predetermined angles, a hydraulic pressure driving section 62 which is installed below the bed 12 and which generates a hydraulic pressure signal based on the rotation instruction, and a hydraulic pressure cylinder 40 of which one side is fixed at a lower frame 16 to support lower part of the bed 12 and the other side is fixed on a lower surface of the bed 12, and which is capable of expanding or withdrawing according to the hydraulic pressure signal of the hydraulic pressure driving section 62.

It is preferable that the control section outputs the rotation instruction so as to rotate the bed 12 clockwise or counterclockwise at 1° intervals in the range of 0° and 80°, and further comprises a timer 23 to set an operation time.

It is also preferable that the control section further comprises converting means for converting a feedback signal of the hydraulic pressure cylinder 40 to an inclination angle of the bed 12.

And the present invention preferably further comprises an inclination display section 22 for displaying the inclination angle to be outputted by the converting means.

And the present invention more preferably further comprises display means for displaying alpha waves and beta waves separated by the separation means.

In addition, to achieve these and other advantages and in accordance with the purpose of the present invention, there is provided a method to adjust the slope of a bed according to brain waves, wherein the method comprises steps of inclining the bed 12 to predetermined reference angles around a rotation central hinge 18 mounted on one side of the lower part of the bed of which an ankles fixing device 14 is mounted at one side (S10), detecting brain waves from brain waves detection means 50 which is mounted at another side of the bed 12, and which user is able to put on (S20), separating alpha waves and beta waves having predetermined frequency range from the brain waves (S30), rotating the bed 12 from the reference angle and monitoring the variation of alpha waves and beta waves in a real time, and maintaining the inclination of the bed 12 for predetermined period when the maximum alpha waves are detected (S50).

Here, it is preferable that the method further comprises the step of recovering the inclination of the bed 12 to the reference angle if detected beta waves are over a limit or pulse waves are not regular (S60).

It is also preferable that the method further comprises the step of reducing the inclination angle of the bed 12 decrementally as an operation time approaches a predetermined maximum operation time set by a timer.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A bed to adjust the inclination of the bed according to brain waves and a method thereby according to the present invention will be described herebelow with reference to the accompanying drawings.

First of all, the structure of a bed to adjust the inclination of the bed according to brain waves according to the present invention will be described.

Figure 1:
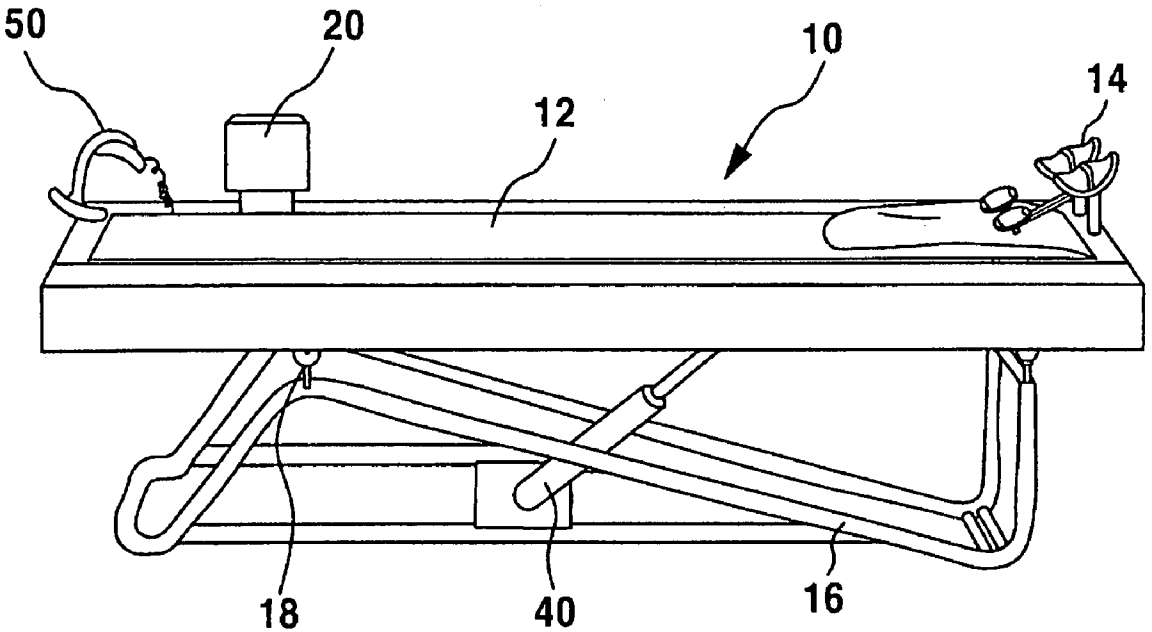
FIG. 1 is a schematic view showing a bed apparatus 10 to adjust the inclination of the bed according to brain waves according to the present invention.
Figure 2:
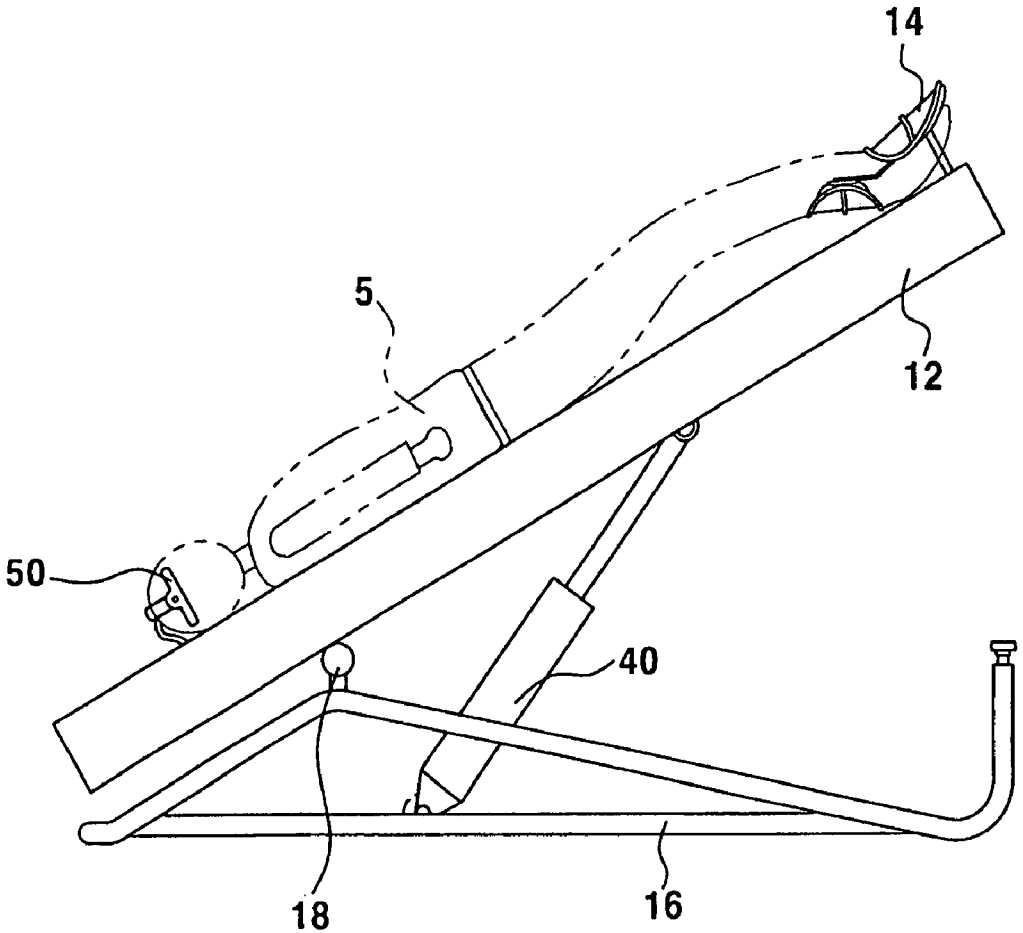
FIG. 2 is a front view showing a bed under the inclined condition.

FIG. 1 is a schematic view showing a bed apparatus 10 to adjust the inclination of the bed according to brain waves according to the present invention and FIG. 2 is a front view showing a bed under the inclined condition. As shown in FIG. 1 and FIG. 2, a bed 12 is formed for user to lie on. An ankles fixing device 14 is installed at contacting user's legs and a head set (brain waves detection means) 50 is linked at contacting user's head. And a control panel 20 is protruded at one side of the middle region of the bed 12.

A rotation central hinge 18 is linked in approximate one third region from a head of user on the lower part of the bed 12 such that the bed 12 is capable of rotating around the rotation central hinge 18.

A bottom frame 16 is manufactured by bending steel pipes and has a structure to support the bed 12.

One side of a hydraulic pressure cylinder 40 is fixed at the bottom frame 16 and the other side is fixed on the lower surface of the bed 12. A hydraulic pressure driving section 62 (not shown in FIGS. 1 and 2) is mounted at one side of the hydraulic pressure cylinder 40. The hydraulic pressure driving section 62 comprises a hydraulic pressure motor, a hydraulic pressure tank, a direction control circuit, a pressure control valve, etc.

Accordingly, as shown in FIG. 2, the bed 12 is rotated counterclockwise around the rotation central hinge 18 as the hydraulic pressure cylinder is expanded.

Figure 3:
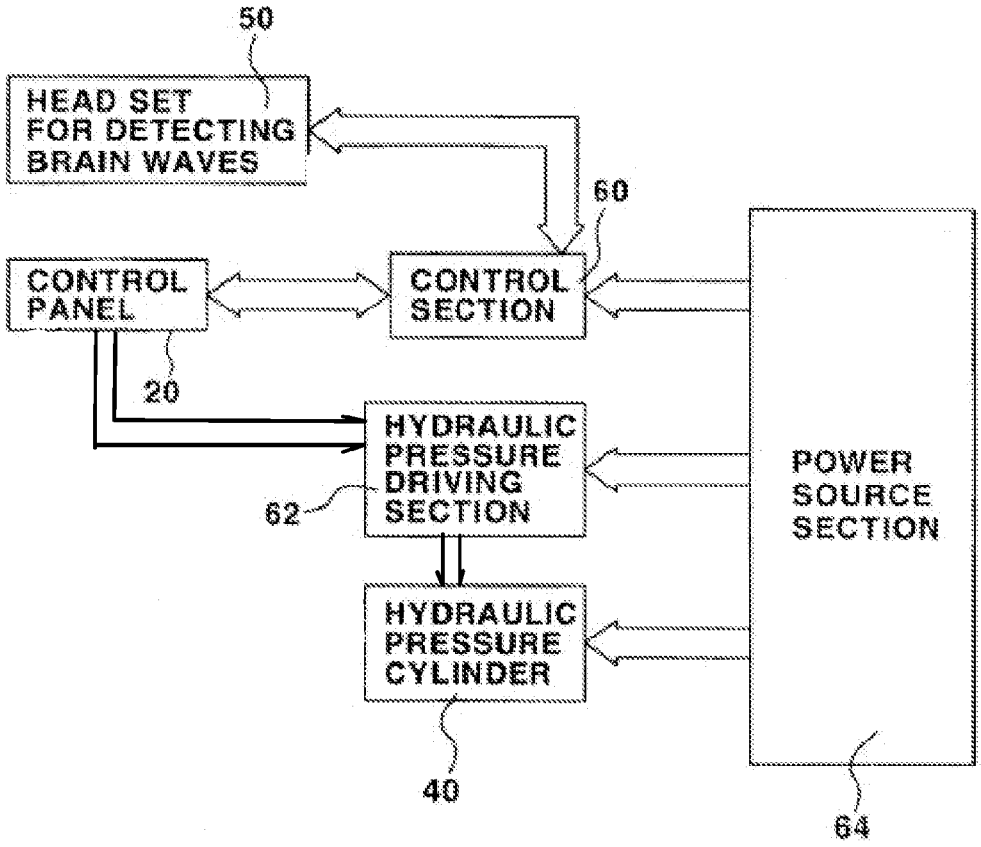
FIG. 3 is a block diagram of a bed apparatus 10 to adjust the inclination of the bed according to brain waves according to the present invention.

FIG. 3 is a block diagram of a bed apparatus 10 to adjust the inclination of the bed according to brain waves according to the present invention. As shown in FIG. 3, a detection signal from a head set 50 is inputted to a control section 60 and a key input signal inputted from a control panel 20 is transmitted to the control section 60.

A control instruction of the control section 60 is related to the inclination angle of the bed, and is inputted to a hydraulic pressure driving section 62. Then, a hydraulic pressure signal is converted from the electrical signal of the control instruction inputted to the hydraulic pressure driving section 62 and is applied to the hydraulic pressure cylinder 40.

The bed apparatus according to the present invention has a power source section 64 to provide AC power source and DC power source for entire operation as above described.

Figure 4:
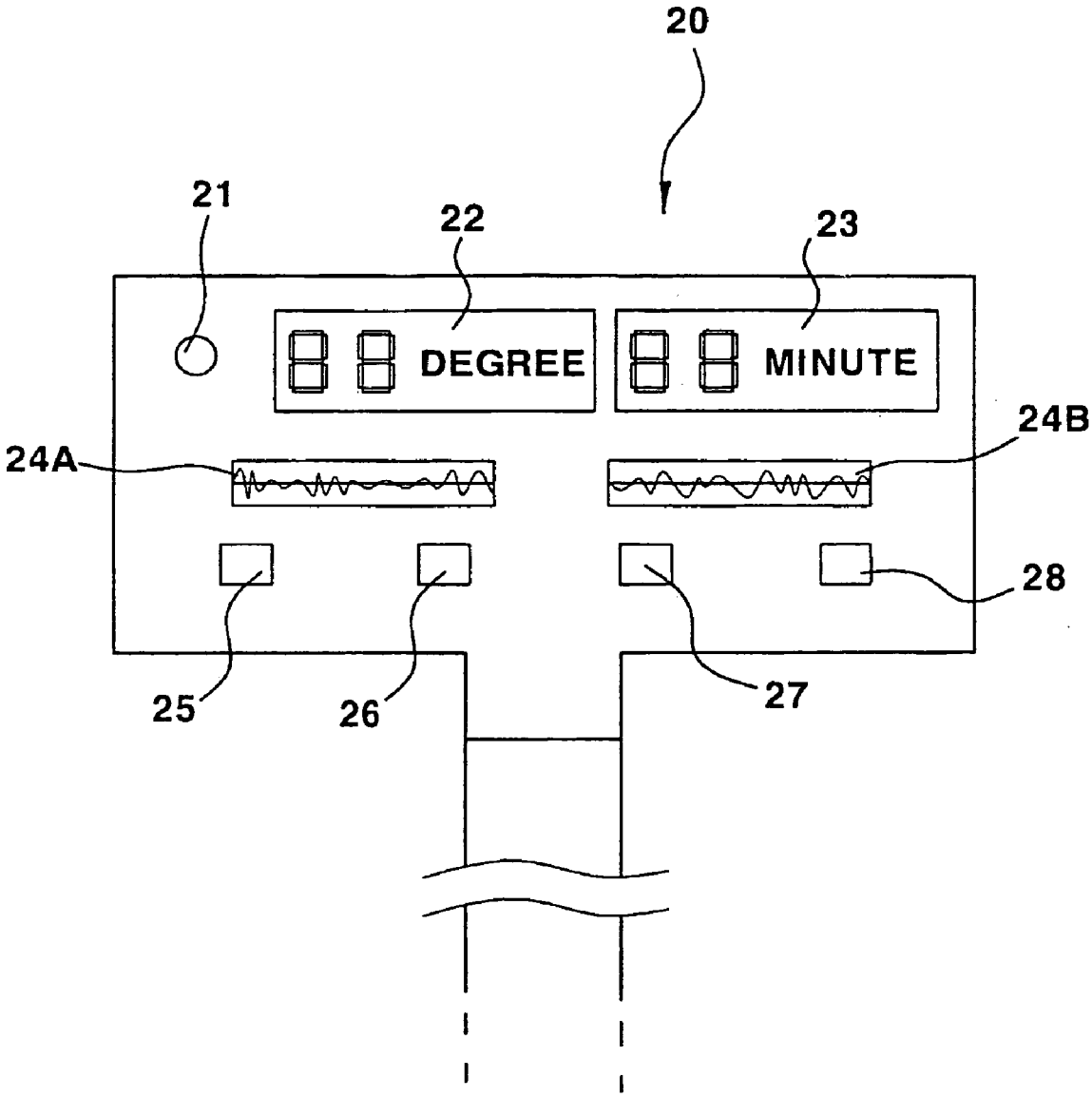
FIG. 4 is an enlarged front view of a control panel 20.

FIG. 4 is an enlarged front view of a control panel 20. As shown in FIG. 4, the control panel 20 comprises a power source display section 21, an inclination display section 22, and a timer 23 to display an operation time by minute on the upper part thereof.

The control panel 20 has a brain waves display window on the middle part, which displays detected brain waves by frequency or the variation of amplitude by hour. The brain waves display window is preferably separated to an alpha waves display window 24A and a beta waves display window 24B as shown in FIG. 4. The alpha waves display window 24A displays a variation of alpha waves detected from a brain and the beta waves display window 24B displays a variation of beta waves detected.

The control panel 20 comprises a start button 25 to initiate operating of the bed apparatus, a reservation time button 26 to increase or decrease a reservation time by the minute, a manual ascent operation button 27 which is capable of manually rotating a bed counterclockwise, and a manual descent operation button 28 which is capable of manually rotating a bed clockwise. And a terminal to be positioned at a side of the control panel 20 is linked to a wire 54 (not shown in FIG. 4) of a head set 50.

Figure 5:
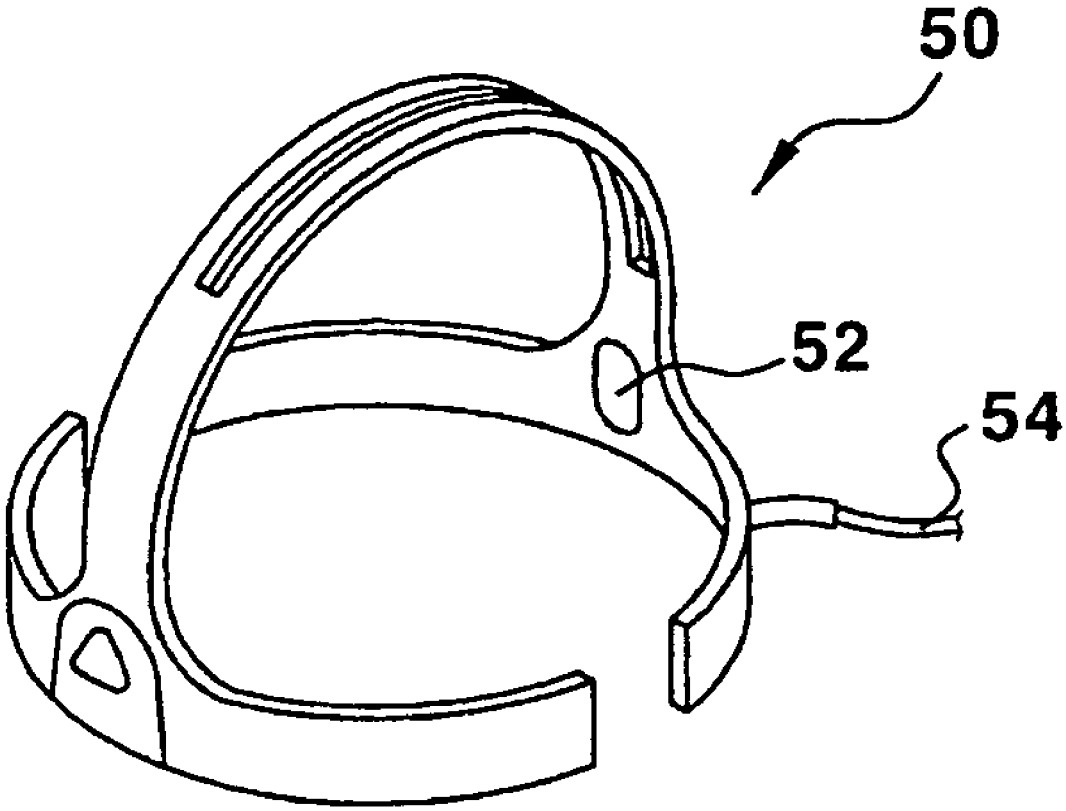
FIG. 5 is a schematic view of a head set 50.

FIG. 5 is a schematic view of a head set 50. As shown in FIG. 5, the head set 50 is formed for user 5 to put on over his head and includes a brain waves detection sensor 52 which is positioned at the temple section of user. A signal detected by the brain waves detection sensor 52 is transmitted to the control section 60 via a wire 54. This transmission can be performed not only by the wire 54 as shown in FIG. 5, but also by wireless signal transmission means. For this, a wireless transmitter (driven by electric waves or infrared rays) is mounted at the head set 50 and a wireless receiver (driven by electric waves or infrared rays) is built in the control panel 20.

A method to adjust the inclination of the bed according to brain waves according to the present invention which has the structure above described will be explained.

Figure 6:
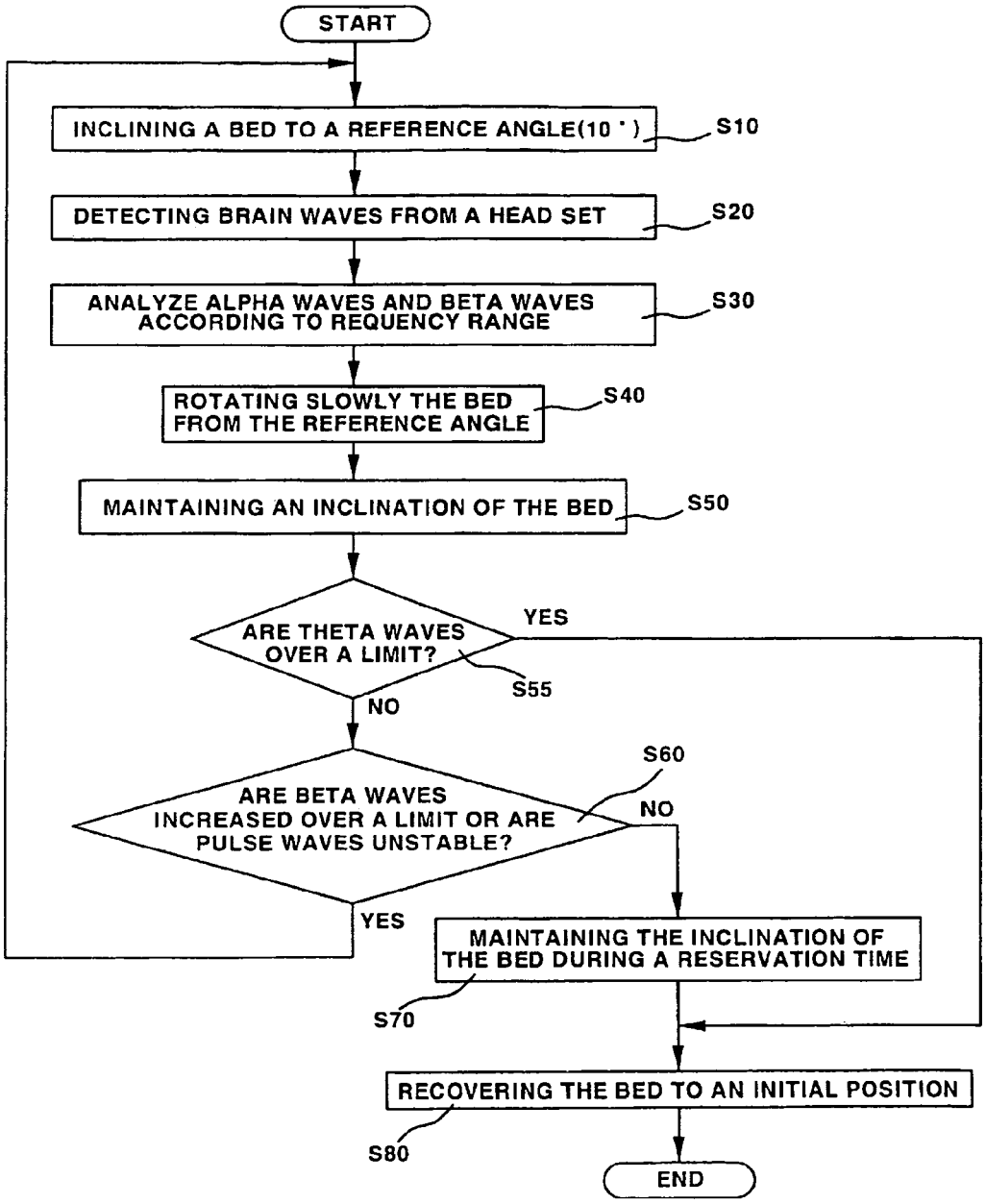
FIG. 6 is a flow chart showing a method to adjust the inclination of the bed according to brain waves according to the present invention.

FIG. 6 is a flow chart showing a method to adjust the inclination of the bed according to brain waves according to the present invention. As shown in FIG. 6, first of all, user 5 lies on the bed 12 which is horizontal and fixes ankles at an ankles fixing device 14 and then puts on a head set 50. Here, ankles, waist, and chest parts are capable of being fixed by using band attached on the bed 12 if necessary.

Then, user presses a reservation time button 26 to have a timer 23 display 20 minutes thereon. And user presses a start button 25. In case that a signal of the start button 25 is transmitted to a control section 60, the control section 60 inclines the bed 12 at an initial reference angle (10°) (S10). A control instruction about the reference angle outputted at the control section 60 is converted to a hydraulic pressure signal corresponding to 10° at a hydraulic pressure driving section 62 and the hydraulic pressure signal is transmitted to a hydraulic pressure cylinder 40. The hydraulic pressure cylinder 40 is expanded as the length as desired by the hydraulic pressure signal transmitted.

In case that the hydraulic pressure cylinder 40 is expanded, the bed 12 is rotated counterclockwise around the rotation central hinge 18 as much as 10°, since a bottom frame 16 is fixed. Since both parameters about the hydraulic pressure cylinder 40 and parameters about the bed are constant, the expansion and withdrawing levels are proportional to the inclination of the bed 12.

Then, the feedback signal from the hydraulic pressure cylinder 40 is converted to numerical value 10° and displayed on an inclination display section 22 of the control panel 20. Accordingly, user 5 is able to recognize that his head is lowered and the bed is inclined at 10° by the display of the inclination display section 22.

Since blood is concentrated at user's head after the initial reference angle is lasting for several minutes, brain waves begin to change. Then, a head set 50 detects brain waves (S20). The detected brain waves are transmitted to the control section 60 via an analog-to-digital converter (not shown), a filter (not shown), an amplifier (not shown), and a frequency analyzer (not shown).

The control section 60 (for example, CPU or micom) analyzes brain waves into alpha waves (8~14 Hz), beta waves (14~30 Hz), gamma waves (30~50 Hz), theta waves (4~8 Hz) by frequency bandwidth and also analyzes pulse waves together with brain waves. These pulse waves also are capable of being detected by a brain waves detection sensor.

Then, the present invention slowly rotates the bed 12 within the angular range of 10°~40° (S40). For example, an angular velocity may be around 10° per minute. The head set 50 detects brain waves in a real time during rotating such that the present invention sets the angle at which maximum alpha waves are detected (S50).

Since maximum alpha waves are generated in case to maintain the detected angle for a determined period, user 5 is able to be relaxed, stress relieved, and mentally stabilized with constant pulse waves.

As unexpected conditions (for example, a nightmare, an excitation, a tension, etc) are generated to user 5 during the operation of the bed, beta waves may increase over the limit or pulse waves may become unstable. The head set 50 detects variations like above conditions (S60), the method according to the present invention recovers the bed 10 to the reference angle (10°) such that decreases blood amount pumped into a brain. Then, after stable brain waves are detected, the method according to the present invention rotates again to the angle at which maximum alpha waves are detected.

After maintaining the inclination of the bed 12 during a reservation time (S70), the bed is slowly rotated to lower one of angles at which the alpha waves are detected as the reservation time comes closer. Then, the method gradually retraces the bed to the horizontal position in proportion to the remained operation time. That is, this retracing operation is for preventing the bed from rapidly recovering to the horizontal position. The retracing operation may be performed in case to approach a maximum operation time (for example, 30 minutes) without relating to a reservation time.

Especially, in case to detect alpha waves (8~14 Hz), frequency range may be detected by subdivision. That is, first of all, the present invention monitors whether alpha waves having frequency range 10~12 Hz are detected, and then monitors whether alpha waves having frequency range 8~10 Hz are detected, if not, monitors whether alpha waves having frequency range 12~14 Hz are detected.

If user falls asleep being relaxed of tension during operation, theta waves are increased. The control section 60 revokes the adjustment operation of the inclination and makes the bed 12 horizontal (S55) such that user 5 is able to sleep tranquilly on the bed 12.

In case that user 5 wishes to avoid the control operation of the control section 60, he is able to directly input an inclination angle by using manual operation button (clockwise) 27 and manual operation button (counterclockwise) 28 while watching the inclination display section 22.

The present invention may be formed to be capable of performing a heat operation with thermal wires installed in the bed 12, and to massage the body part including waist, shoulders, or chest with vibration by a vibration massage device mounted in the bed 12.

Also, the present invention may have speakers built-in and install a music play device (for example, tape recorder, CD player, memory chip) at the control panel 20 such that user is able to listen sound of water, bird, or peaceful music.

Another modification of the present invention may have a sealing device to be capable of being opened or closed over the upper surface of the bed 12, and may inject ionized oxygen inside. In accordance with that, a lot of ionized oxygen are provided into user's brain during breath such that the present invention is capable of preventing an ill effect of noxious active oxygen. For this, the present invention may have an oxygen tank, flux control valve, etc.

Even though the present invention utilizes a hydraulic pressure device, the present invention may use an air pressure device or a gear with an electrical motor.

INDUSTRIAL APPLICABILITY

As so far described, according to a bed to adjust the slope of the bed according to brain waves and a method thereby, the present invention has a feature to automatically control the inclination of the bed so that maximum alpha waves may be detected. Accordingly, the present invention maintains the mentally stable condition of user, and relaxes his tension.

Moreover, the present invention is capable of preventing excessive blood from being provided into a brain, and is capable of setting an operation time by a timer. And user is able to confirm the inclination of the bed by numerical values.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

The invention claimed is:

1. A brain-wave adjustable bed, comprising:

a) a bed having an upper surface, a lower surface, a head end, a foot end and sides between the head end and the foot end;

b) an ankles fixing device mounted adjacent the foot end of the bed;

c) a bottom frame for supporting the bed, the bed being rotatably mounted to the bottom frame by a central hinge, so that the bed may rotate within predetermined angles around the central hinge;

d) a brain waves detection means comprising:

i) a head set for a user lying on the bed to put on;

ii) a control section having an input coupled to the head set and an output displayed on a control panel; the output producing a signal representing brain waves of the user wearing the head set, the brain waves comprising at least alpha waves and beta waves;

iii) a frequency analyzer for separating alpha wave and beta wave components in the brain waves, comprising an input coupled to the output of the control section of the brain waves detector, a filter for separating at least the alpha waves from the signal on the output of the control section based upon a frequency range and an output comprising at least an alpha signal proportional to an amplitude of alpha waves in the brain waves; and e) means for adjusting the inclination of the bed, coupled to the bed and the frame, having a control input coupled to the output of the frequency analyzer of the brain waves detection means and a mechanical output which rotates the bed in response to a signal on the control input, so that the bed is rotated to a predetermined selected angle based upon the amplitude of at least the alpha signal.

2. The bed according to claim 1, wherein the adjustment means further comprises:

a control section which outputs a rotation instruction so as to rotate the bed by predetermined angles;

a hydraulic pressure driving section which is installed below the bed and which generates a hydraulic pressure signal based on the rotation instruction; and a hydraulic pressure cylinder of which one side is fixed to the bottom frame and the other side is fixed to the lower surface of the bed, and which is capable of expanding or withdrawing according to the hydraulic pressure signal of the hydraulic pressure driving section.

3. The bed according to claim 2, in which the means for adjusting the inclination of the bed rotates the bed at increasing angles from a horizontal to maximize the alpha signal and further comprises a timer to set an operation time.

4. The bed according to claim 2, wherein the control section further comprises means for converting a feedback signal of the hydraulic pressure cylinder to a predetermined inclination angle of the bed.

5. The bed according to claim 4, further comprising an inclination display section for displaying the inclination angle of the bed.

6. The bed according to claim 1, further comprising means for displaying alpha waves and beta waves separated by the frequency analyzer.

7. The brain-wave adjustable bed of claim 1 wherein the output of the frequency analyzer further comprises a beta signal proportional to an amplitude of beta signals in the brain waves, and the means for adjusting the inclination of the bed rotates the bed to a predetermined angle based upon the amplitude of both the alpha signal and the beta signal.

8. The bed of claim 1 further comprising a timer to set an operation time.

9. A method to adjust a slope of a bed according to brain waves comprising the, steps of:

a) providing a brain-wave adjustable bed having an upper surface, a lower surface, a head end, a foot end, sides between the head end and the foot end and predetermined rotation reference angles around a central hinge mounted to the lower surface of the bed, the foot end having an ankles fixing device mounted thereon;

b) detecting brain waves from a brain waves detection means which is mounted at the head end of the bed and which is placed on a user of the bed;

c) separating alpha waves and beta waves having predetermined frequency range from the brain waves by means of a frequency analyzer;

d) rotating the bed in response to variations in the alpha waves and beta waves detected by the frequency analyzer; and e) rotating the bed at increasing angles from the horizontal to maximize the alpha signal and resetting the bed toward the horizontal in response to increasing beta waves.

10. The method according to claim 9, further comprising the step of reducing the inclination angle of the bed decrementally as an operation time approaches a predetermined maximum operation time set by a timer.

11. The brain wave adjustable bed of claim 7 in which the means for adjusting the inclination of the bed rotates the bed at increasing angles from a horizontal to maximize the alpha signal and resets the bed toward the horizontal based on an increasing amplitude of the beta signal.

* * * * *